US007992865B2

(12) United States Patent
Sugizaki et al.

(10) Patent No.: US 7,992,865 B2
(45) Date of Patent: Aug. 9, 2011

(54) TRAY, IMAGE FORMING APPARATUS, AND PAPER SHEET POST-HANDLING DEVICE

(75) Inventors: Yoshiaki Sugizaki, Shizuoka-ken (JP); Kikuo Mizutani, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 72 days.

(21) Appl. No.: 12/473,047

(22) Filed: May 27, 2009

(65) Prior Publication Data

US 2009/0309294 A1 Dec. 17, 2009

Related U.S. Application Data

(60) Provisional application No. 61/073,023, filed on Jun. 16, 2008.

(30) Foreign Application Priority Data

Oct. 21, 2008 (JP) ..... P2008-270704

(51) Int. Cl.
*B65H 31/20* (2006.01)

(52) U.S. Cl. ..... 271/223; 271/207

(58) Field of Classification Search ..... 271/171, 271/207, 220, 223; 400/646
See application file for complete search history.

(56) References Cited

U.S. PATENT DOCUMENTS 5,613,672 A * 3/1997 Tanaka et al. ..... 271/162
7,413,183 B2 8/2008 Asada et al.

FOREIGN PATENT DOCUMENTS

JP 61-064661 4/1986
JP 2002-332155 11/2002
JP 2004-010220 1/2004

OTHER PUBLICATIONS

Office Action dated Sep. 14, 2010 in counterpart Chinese Counterpart Application 2009101430862 with English Translation.

* cited by examiner

*Primary Examiner* — Michael C McCullough
(74) *Attorney, Agent, or Firm* — Patterson & Sheridan, LLP

(57) ABSTRACT

A tray comprises a main body to support a sheet, an extension member rotatably mounted to the main body and extending from the main body in the discharging direction of the sheet to support a part of the sheet discharged from the main body, first and second shafts provided at the end of the extension member and inserted in first and second holes formed on the main body, and a projection provided on the second shaft inserted in the second hole.

13 Claims, 9 Drawing Sheets

TRAY, IMAGE FORMING APPARATUS, AND PAPER SHEET POST-HANDLING DEVICE

CROSS-REFERENCE TO RELATED APPLICATION

This application is based upon and claims the benefit of priority from the prior U.S. patent application No. 61/073,023, filed on Jun. 16, 2008, and Japanese Patent Application No. 2008-270704, filed on Oct. 21, 2008; the entire contents of all of which are incorporated herein by reference.

FIELD OF THE INVENTION

The present invention relates to a tray, an image forming apparatus, and a sheet post-handling device.

DESCRIPTION OF THE BACKGROUND

As disclosed in the Japanese Patent Application Publication No. 2004-10220, conventionally, in image forming apparatus there is known a paper sheet receiving tray provided an extension member slidably or rotatably mounted on an end of the tray for expanding the paper sheet receiving surface, in order that when a lengthy sheet is loaded thereon, the extension member is able to appropriately support the lengthy sheet without the tip of the sheet hanging down.

As an example of such an extension member, a U-shaped extension member is quoted. The U-shaped extension member is pivotally mounted to the try by inserting pivot shafts provided on both ends of the extension member into two shaft bearing holes provided on an end of the tray. Since such an extension member is mounted by the pivot shafts at the two ends of the extension member being simply inserted into the shaft bearing holes, there is a feature that the extension member easily disengages from the tray. Accordingly, also when stiff external force is applied to the extension member, the extension member separates from the tray before wrecking. As a result, the extension member can be prevented from wrecking.

In order to prevent wrecking of the U-shaped extension member mounted to the tray of an image forming apparatus when stiff external power is applied to the extension member, the extension member is structured to disengage from the tray before wrecking. However, there presents a problem that the extension member disengages from the tray on the way of rotating the extension member by hand, and thus letting hard to handle.

SUMMARY OF THE INVENTION

An object of the present invention is to provide a tray, an image forming apparatus and a sheet post-handling device which have an extension member which is able to be easily handled by that the extension member is hard to come off when rotated by hand while comes off when stiff external power is applied.

In one aspect of the present invention, there is provided a tray comprising a main body to support a sheet; an extension member rotatably mounted to the main body and extending from the main body in the discharging direction of the sheet to support a part of the sheet discharged from the main body; first and second shafts provided at the end of the extension member and inserted in first and second holes formed on the main body; and a projection provided on the second shaft inserted in the second hole.

In another aspect of the present invention, there is provide an image forming apparatus including an image reading unit to read image from a document, an image forming unit to output the image, a document loading tray to load a document to be fed into the image reading unit, a sheet supply tray to supply a sheet into the image forming unit, a sheet receiving tray on which the sheet carrying the output image is discharged, wherein at least any one of the document loading tray, the sheet supply tray and the sheet receiving tray, comprising a main body to support the sheet or the document; an extension member rotatably mounted to the main body and extending from the main body in the discharging direction of the sheet or document to support a part of the sheet or document discharged from the main body; first and second shafts provided at the end of the extension member and inserted in first and second holes formed on the main body; and a projection provided on the second shaft inserted in the second hole.

In still another aspect of the present invention, there is provided a sheet post-handling device provided with a sheet receiving tray to support a sheet to which the sheet is discharged after image is formed by an image forming apparatus, wherein the sheet receiving tray comprising a main body to support the discharged sheet; an extension member rotatably mounted to the main body and extending from the main body in the discharging direction of the sheet to support a part of the sheet discharged from the main body; first and second shafts provided at the end of the extension member and inserted in first and second holes formed on the main body; and a projection provided on the second shaft inserted in the second hole.

DETAILED DESCRIPTION OF THE INVENTION

Hereafter, one embodiment of the present invention will be described in reference to the attached drawings.

Figure 1:
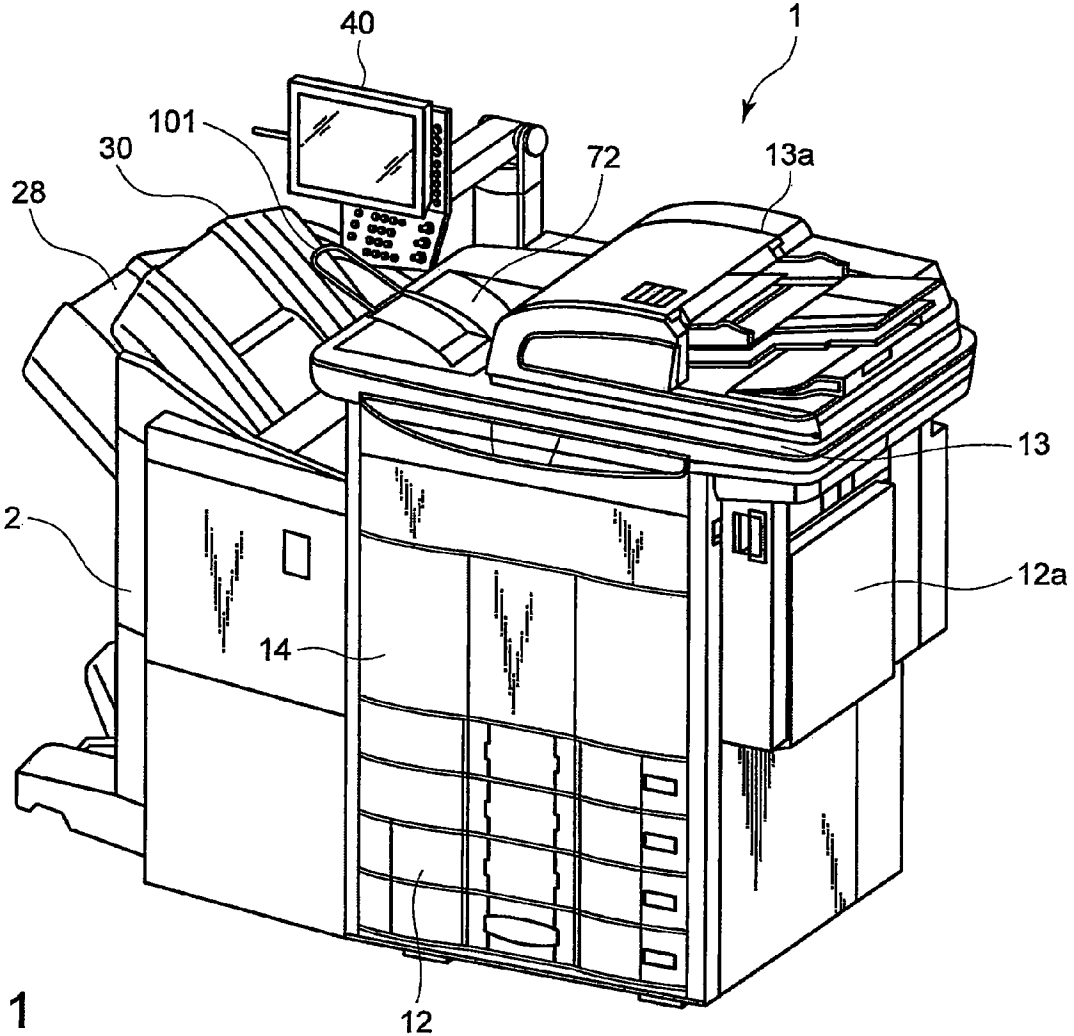
FIG. 1 is a perspective view showing the appearance of the image forming apparatus to which a tray bearing an extension member according to the first embodiment of the present invention is made to be coupled.

(First Embodiment) FIG. 1 is a perspective view showing an image forming apparatus 1 wherein an extension member 101 is fixed to a receiving tray 72. The image forming apparatus 1 has an image forming unit 14 to output image information as an image. The image forming apparatus 1 has also a sheet supply unit 12 which can feed the sheet P of arbitrary size used for an image output to the image forming unit 14. The image forming apparatus 1 has more an image reading unit 13 which takes the image formation subjected for forming image in the image forming unit 14 from a document as an image data.

The image reading unit 13 is equipped with an automatic document feeder (ADF) 13*a* which discharges a document of which image finishes to be read from a reading position to a discharge position, and leads a following document to the reading position. Further, on the side of the image forming apparatus 1, a manual sheet supply tray 12*a* is equipped to supply a sheet not stored in the sheet supply unit 12 and thus the sheet supply unit 12 is unable to feed the sheet.

The image forming apparatus 1 is further equipped with a control panel 40 for directing the start of forming image in the image forming unit 14 and the start for reading the image information of the document by the image reading unit 13. The position on which on operating portion of the control panel 40 is provided is assumed as the front side of the image forming apparatus 1, and its opposite side, i.e., the backside seen from a user is called as a rear side of the image forming apparatus 1. The image forming apparatus 1 is further equipped with a first receiving tray 72 on the upper surface. The image forming apparatus 1 is also equipped with a sheet post-handling device 2 on a position adjacent to a sheet discharge port, the sheet post-handling device 2 performing a sheet handling such as sorting or stapling sheets P after carried out image forming operation.

Figure 2:
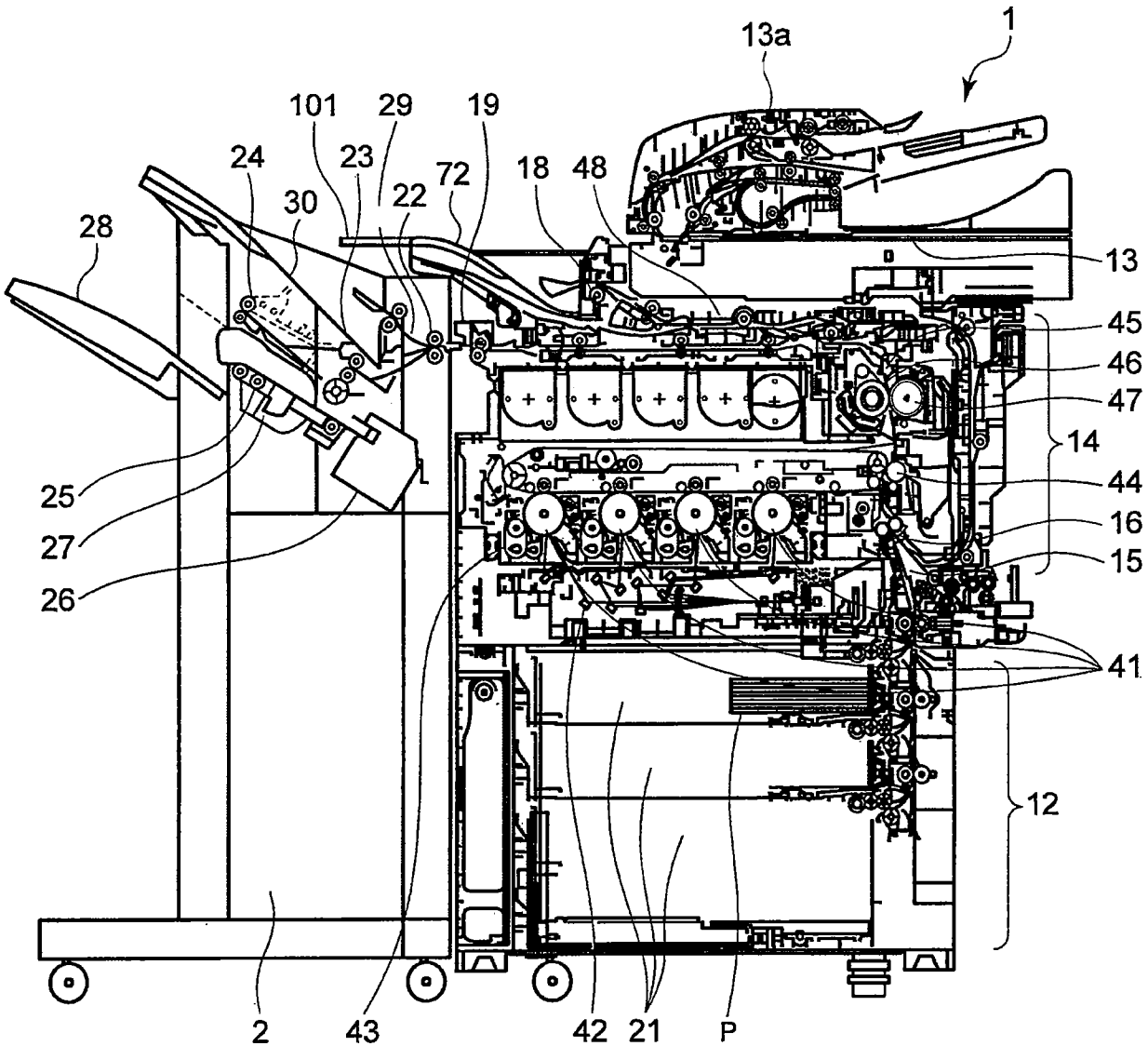
FIG. 2 is a sectional view of the showing the internal constitution of the image forming apparatus to which a tray bearing an extension member is coupled.
Figure 3A:
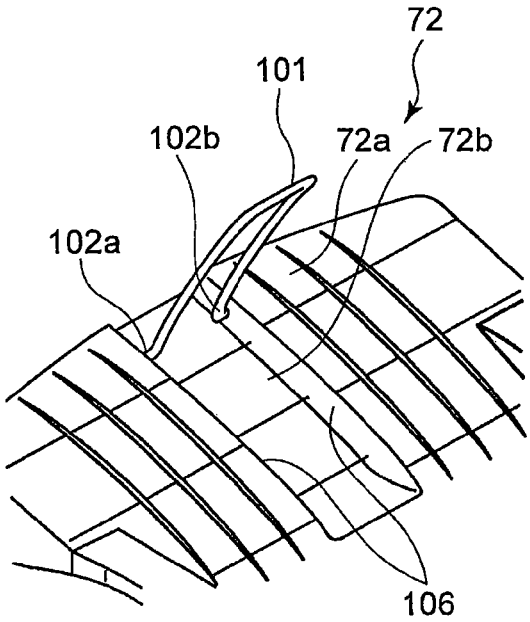
FIG. 3A to FIG. 3C are perspective views showing the first sheet receiving tray part.
Figure 3B:
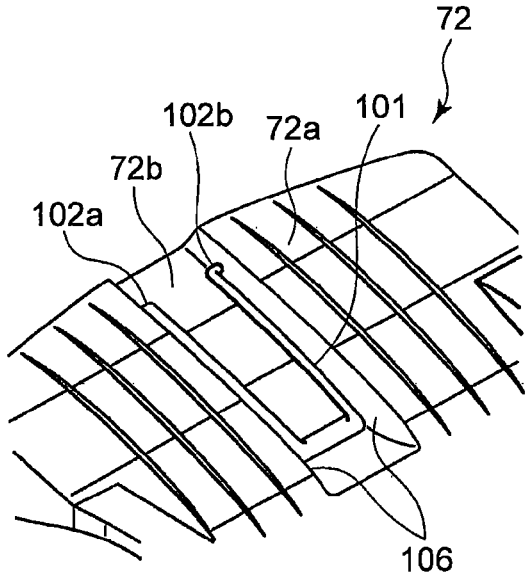
Figure 3C:
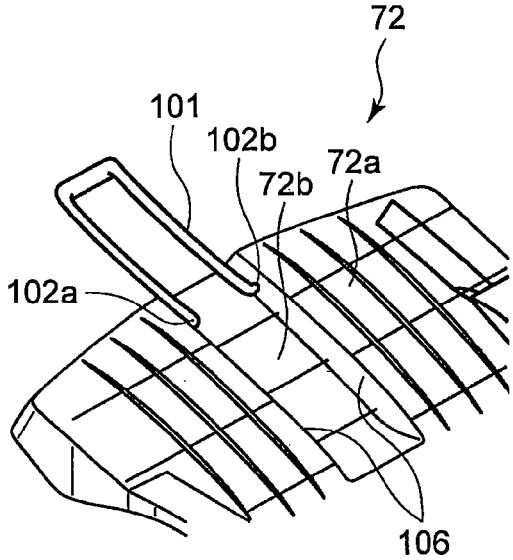

FIG. 2 is a sectional view showing the internal constitution of the image forming apparatus 1.

The image forming apparatus 1 is equipped with the sheet supply unit 12 which is capable of storing a plurality of sheets P for supplying sheets P to a sheet conveying path 15 formed along a prescribed passage, the image reading unit 13 which takes the image formation subjected for forming image, the image forming unit 14 for forming image on the sheet p, and a sheet conveying unit 16 having guiding members, rollers etc., provided along the sheet conveying path 15. On the upper surface of the image forming apparatus 1, a first sheet discharge port 18 is provided. While below the first sheet discharge port 18, a second sheet discharge port 19 for discharging the sheet P is provided.

The image reading unit 13 takes the image formation subjected for forming image in the image forming unit 14 from a document as an image data. The image forming unit 14 outputs the image corresponding to the image information read out by the image reading unit 13 to the sheet P conveyed as an output image.

The image forming unit 14 includes a photosensitive drum 41 for holding a latent image, an exposure device 42 for forming the latent image on the photosensitive drum 41, and a developing device 43 for developing the latent image formed on the photosensitive drum 41. The image forming unit 14 further includes a transferring device 44 for transferring a toner image developed on the photosensitive drum 41 onto the sheet P with an arbitrary size as an output medium, and a fixing device 45 for fixing the transferred toner image on the sheet P by the transferring device 44. The fixing device 45 is constituted with a fixing roller 46 and a pressing roller 47. The fixing roller 46 and the pressing roller 47 send forth a sheet to the inversion unit 48 at a prescribed velocity. That is, the fixing roller 46 and the pressing roller 47 also act as the sheet conveying unit 16.

According to such a constitution, the sheets P reach to the image forming unit 14 respectively in running upwards from a plurality of sheet cassettes 21 mounted in the lower portion of the image forming apparatus 1 through the sheet conveying path 15, and then formed image thereon. The sheet P formed the image then reaches the first sheet discharge port 18 or the second sheet discharge port 19 through a conveying path of the inversion unit 48 residing at an upper region of the image forming apparatus 1. The first receiving tray 72 is mounted to the first sheet discharge port 18. While, the first receiving tray 72 is mounted on the upper surface of the image forming apparatus 1, and holds the sheet P from the first sheet discharge port 18.

The sheet post-handling device 2 is coupled to the second sheet discharge port 19.

The sheet post-handling device 2 includes a queuing tray 24 for queuing the sheets P sent forth by the entrance roller 22 coupled to the second sheet discharge port 19 of the image forming apparatus 1 and the exit roller 23 by accumulating thereon the sheets P and a sheet handling tray 25 for aligning back ends of the sheets P falling down from the queuing tray 24 for stapling the sheets P. The sheet post-handling device 2 includes further a stapler 26 for stapling the back ends of the sheets P accumulated and aligned on the sheet handling tray 25, a conveying mechanism 27 for conveying the sheets P after carried out stapling, sorting etc., and a second receiving tray 28 for discharging the conveyed sheets P. The sheet post-handling device 2 includes furthermore a conveying path 29 for conveying sheets P not subjected for stapling, sorting etc., and a third receiving tray 30 onto which the sheets P conveyed through the conveying path 29 are discharged.

Referring now to FIG. 3A to FIG. 6, the constitution of the first receiving tray 72 will be described, onto which the sheet P carrying image formed thereon.

The first receiving tray 72 is comprised of a main body 72*a* and an extension member 101 rotatably mounted to the main body 72*a*. The main body 72*a* is formed in the state inclined upward in the sheet discharge direction from the underneath of the first sheet discharge port 18 of the image forming apparatus 1. The main body 72*a* of the first receiving tray 72 is provided with a U-shaped extension member 101 which is constituted by bending wire rod.

Figure 4:
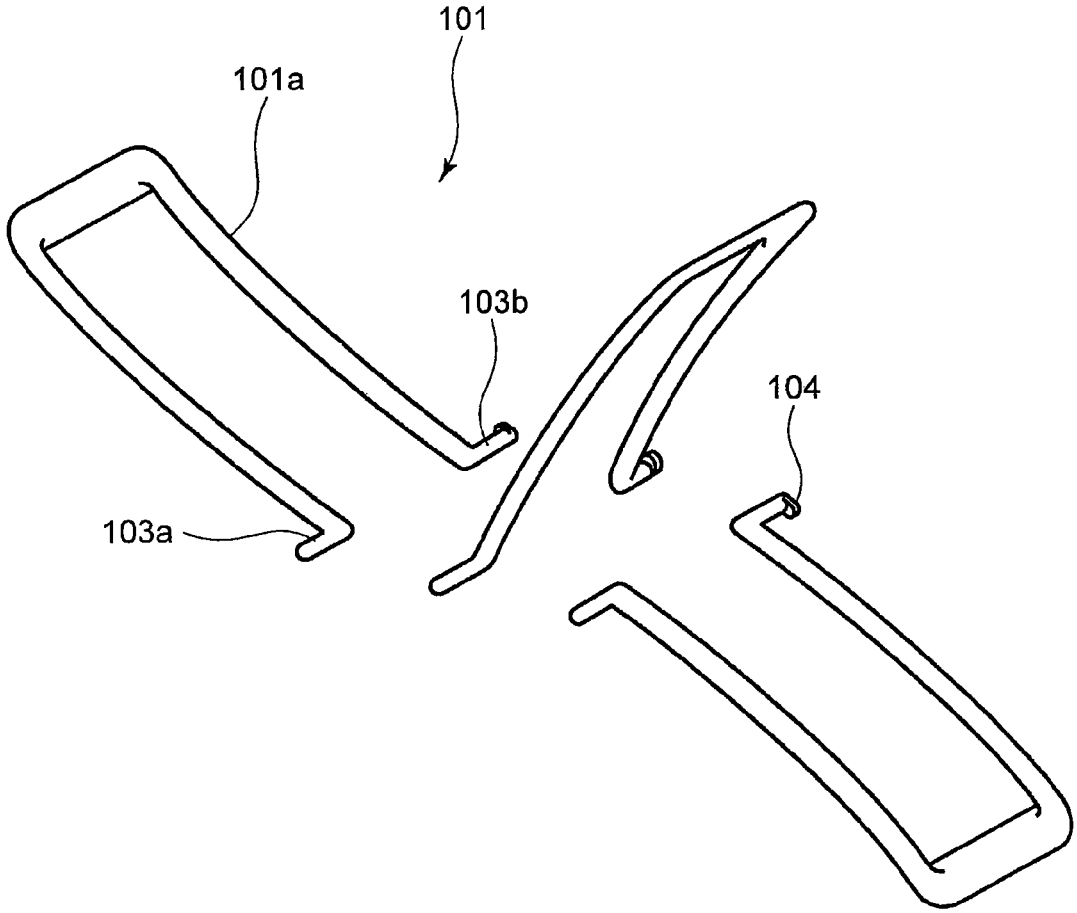
FIG. 4 is a perspective view showing the attitude transition of rotation of the U-shaped extension member.

As shown in FIG. 4, the U-shaped extension member 101 has a first shaft 103*a* formed on a first tip portion of a sheet supporter 101*a* and extending in the direction across the first tip portion of the sheet supporter 101*a*. Further, the sheet supporter 101*a* has a second shaft 103*b* extending in the direction across the second tip portion. The U-shaped extension member 101 is rotatably mounted to the first receiving tray 72 by inserting the first shaft 103*a* into a shaft bearing hole 102*a* and inserting the second shat 103*b* into a shaft bearing hole 102*b* (see FIG. 3A).

Further, the main body 72*a* of the first receiving tray 72 is defined a depressed portion 72*b* for accommodating the extension member 101. The extension member 101 can take an accommodated position (see FIG. 3B) accommodated in the depressed portion 72*b* on the main body 72*a*, and an extended position (see FIG. 3C) rotated toward the sheet discharging direction. Therefore, when discharging a lengthy sheet, the extension member 101 is rotated to the extended position thereby supporting also a leading end portion, i.e., a portion of the sheet. Therefore, the extension member 101 may stably support a lengthy sheet without the leading end portion of the sheet hanging down.

Figure 5:
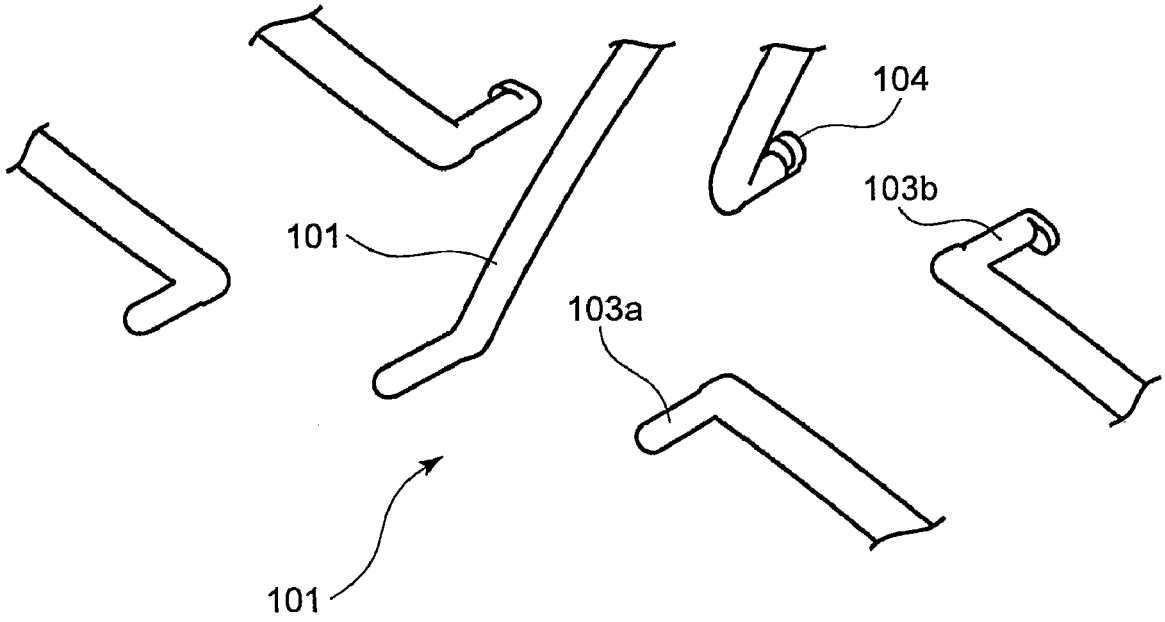
FIG. 5 is an expanded perspective view showing the pivot shaft of the U-shaped extension member in FIG. 4.

As shown in FIG. 4 and FIG. 5, a projection 104 projecting toward the sheet supporter 101*a* longer than the second shaft 103*b* is formed in the tip portion of the second shaft 103*b* of the extension member 101.

By this projection 104, the extension member 101 is avoided from falling out the shaft bearing hole 102*b* when the extension member 101 is rotated. By providing the projection 104 to only the rear-side second shaft 103*b* among the two shafts, the first shaft 103*a* on the front side not provided such projection 104 easily disengages when a stiff external power is applied to the extension member 101, thereby the extension member 101 is prevented wrecking. While the second shaft 103*b* having the projection 104 does not disengage from the tray 72 even when the first shaft 103*a* disengages from the tray 72, thereby the extension member 101 is prevented falling down out from the tray 72.

Figure 6A:
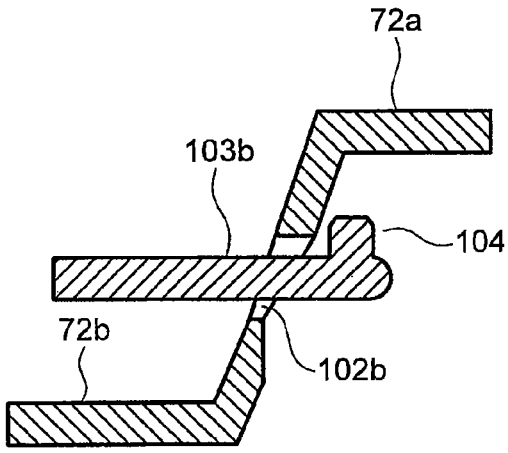
FIG. 6A to FIG. 6C are sectional views of the extension member for showing the state where a shaft of the U-shaped extension member is inserted in the shaft bearing hole.

Further, both the lateral surfaces 106 of the depressed portion 72*b* for accommodating the extension member 101 respectively forms an inclined plane, while as shown in FIG. 6A a rear-side shaft bearing hole 102*b* is formed its axis in parallel with the upper surface of the main body 72*a* of the depressed portion 72*b*. The axis expresses a line passing through the center of the circle of the loading slot of the shaft bearing hole 102*b*.

Figure 6B:
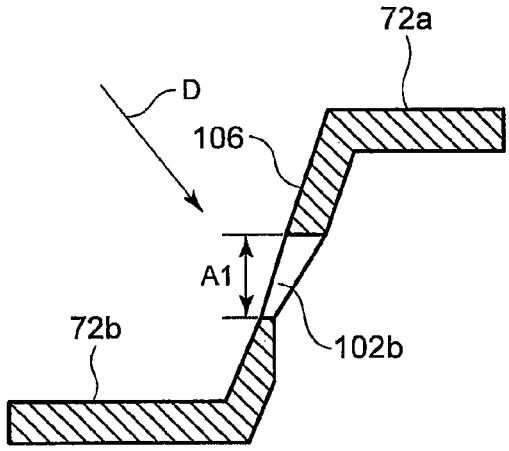
Figure 6C:
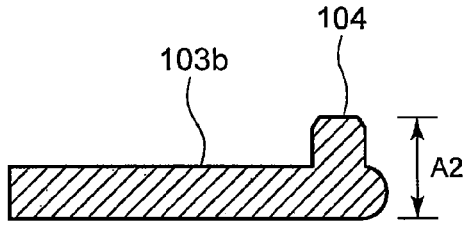

Further, the inclined plane of the lower portion of the second shaft bearing hole 102*b* is cut away. Thereby when inserting the projection 104 the second shaft 103*b* is capable of mounting with the second shaft bearing hole 102*b* by inserting the second shaft 103*b* in the direction toward the rear surface of the main body 72*a*. That is, the projection 104 can be inserted in the direction of the arrow D as shown in FIG. 6B. Further, a diameter of the loading slot of the rear side shaft bearing hole 102*b* is set to A1 as shown in FIG. 6B, and the length of the projection 104 is set to A2 as shown in FIG. 6C, a relation called A1<A2 will be realized. After inserting the second shaft 103*b* into the rear side shaft bearing hole 102*b*, the second shaft 103*b* stops for this reason, separating from the rear side shaft bearing hole 102*b*.

Thus, after the second shaft 103*b* inserted in the rear side shaft bearing hole 102*b*, the paper sheet supporter 101*a* is sagged and then the first shaft 103*a* is mounted by being inserted into the first shaft bearing hole 102*a*.

As described above, the projection 104 of the extension member 101 is provided on the tip of the second shaft 103*b* at the side with the sheet supporter 101*a* against the second shaft 103*b*. Therefore, when rotating the extension member 101 in the extended direction, the projection 104 comes to move by continually contacting with the back side of the lateral surface 106 of the depressed portion 72*b*. Accordingly, it allows that the extension member 101 becomes difficult to disengage from the tray when the extension member 101 is rotated in the extended direction.

The second shaft 103*b* possessing the projection 104 is inserted in the shaft bearing hole 102*b* provided on the rear side of the image forming apparatus 1, and another first shaft 103*a* is mounted by inserting in the shaft bearing hole 102*a* provided on the front side of the image forming apparatus 1. By the power to the front side applied when performing rotating operation of the extension member 101, it becomes difficult to separate by fixing to a rear side the shaft 103*b* which possesses the projection 104 by this.

Although the extension member 101 of the paper sheet receiving tray 72 of the first embodiment becomes hard to disengage from the tray 72 in the course of rotating, by forming the projection 104 in the shaft 103*b* at the rear side of the extension member 101 which pivotally fixes the extension member 101 to the main body 72*a*. When the impossible power from the outside is applied, it has the feature of being hard to break when the front side shaft 103*a* without the projection 104 separates easily.

According to the first embodiment, although the extension member 101 is mounted to the main body 72*a* of the first receiving tray 72, it may be mounted to each main body of a tray of the second receiving tray 28 of a sheet post-handling device, and the third receiving tray 30. The extension member 101 may be mounted to a tray of the ADF 13*a* whereon documents are loaded, the manual sheet supply tray 12*a* etc., not only to a sheet receiving tray for discharging thereon sheets.

(Second Embodiment) Hereinafter, a second embodiment of the present invention will be described in reference to FIG. 7 through FIG. 10.

The second shaft 103*b* of the extension member 101 possesses the projection 104 likewise the first embodiment.

Figure 7:
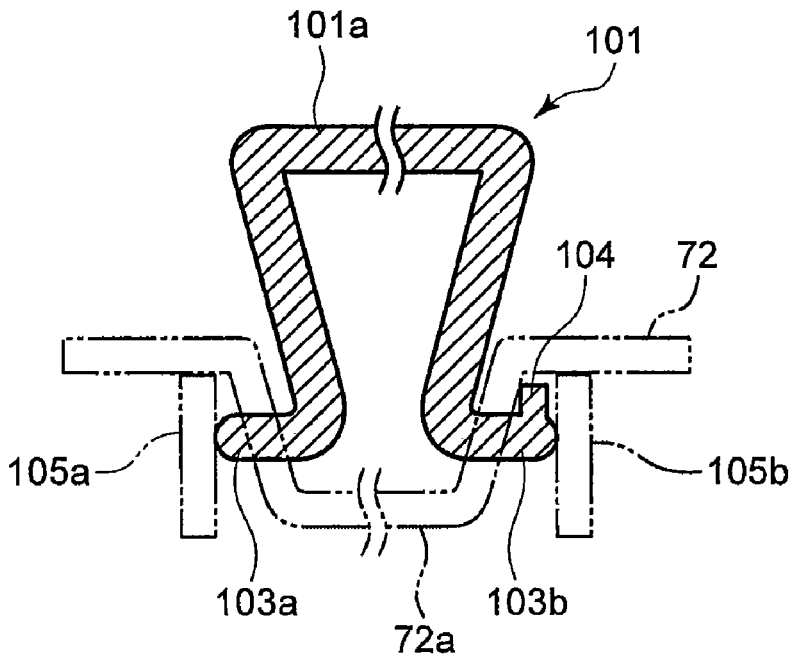
FIG. 7 is a sectional view of the extension member of the extension member for showing a physical relationship of a shaft of the extension member to a wall provided for contacting with a tip portion of the shaft according to a second embodiment of the present invention.
Figure 8:
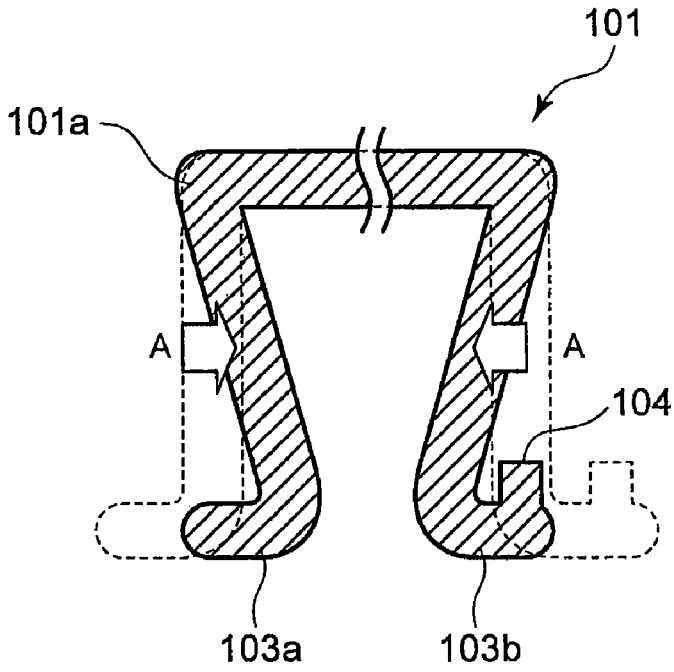
FIG. 8 is a sectional view of the extension member for showing the state where the U-shaped extension member is bent.

As shown in FIG. 7, a pair of walls 105*a* and 105*b* are formed in the lower part (i.e., back side) of the main body 72*a* of the receiving tray 72 at the both sides of the depressed portion 72*b*. Then, the tip portion of the first shaft 103*a* of the extension member 101 contacts the wall 105*a*, and the tip portion of the second shaft 103*b* contacts the wall 105*b* respectively. The extension member 101 is made from the material by which the sheet supporter 101*a* is capable to bend, if a power is applied in the direction of arrow A of FIG. 8.

Figure 9A:
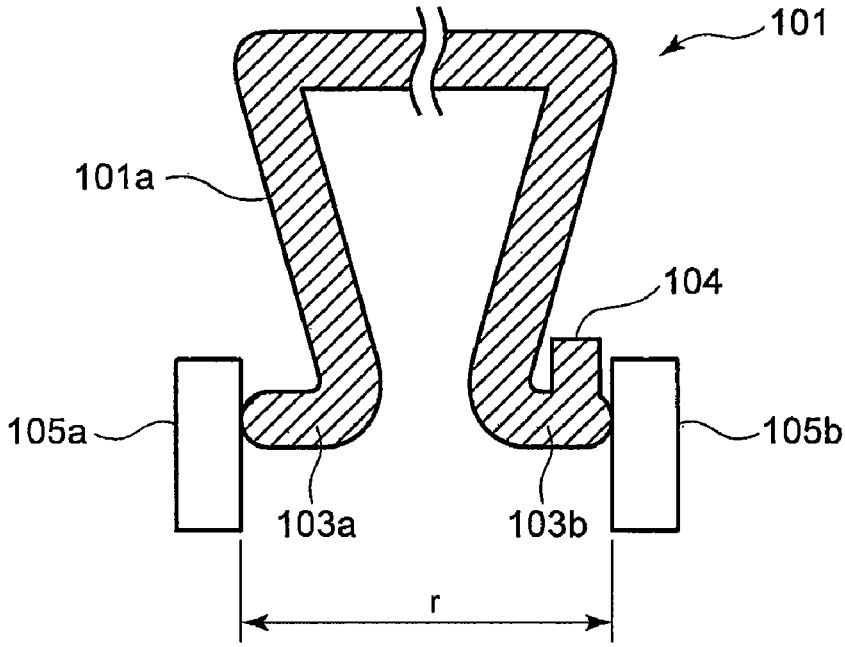
FIG. 9A and FIG. 9B are sectional views of the extension member for showing the distance r between walls to which tip portions of the shafts contact and the distance R between the tip portions of the shaft of the U-shaped extension member.
Figure 9B:
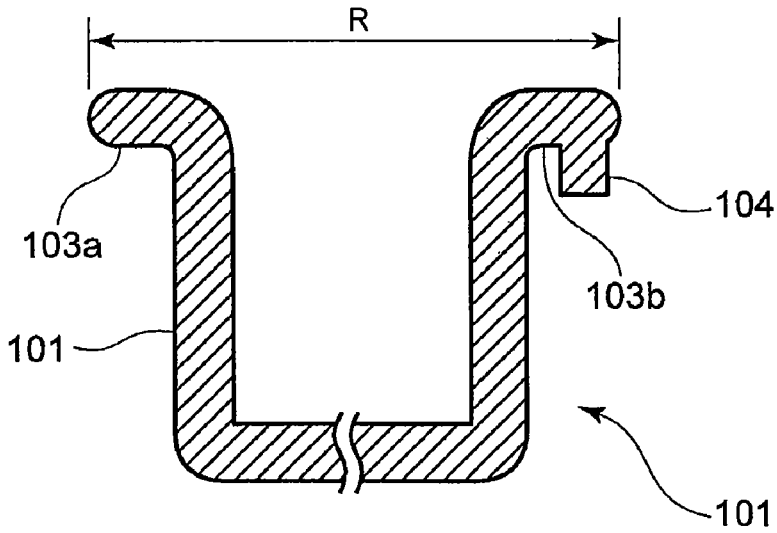

Therefore, when the paper sheet supporter 101*a* is inserted into shaft bearing holes 102*a* and 202*b*, the extension member 101 is sagged in the direction of arrow A. If the distance from the tip of the first shaft 103*a* when the sheet supporter 101*a* is not bent (i.e., not distorted) to the tip of the second shaft 103*b* is set to R and distance from the wall 105*a* to the wall 105*b* is set to r, they have a relation of R>r as shown in FIG. 9A and FIG. 9B. Due to the relation R>r, it will be mounted where the tip portion of the first shaft 103*a* and the second shaft 103*b* contact with pressure to the wall 105*a* and the wall 105*b*.

Figure 10:
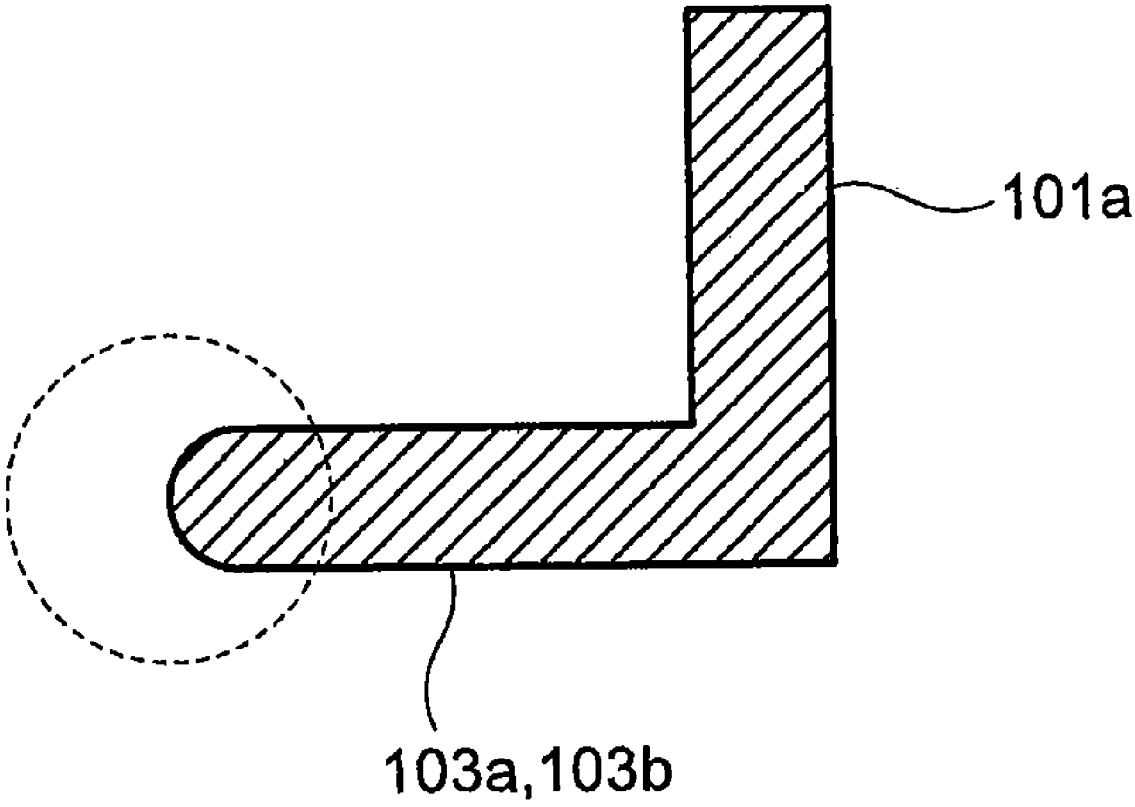
FIG. 10 is a sectional view of the extension member for showing rounded shape of the shaft of an extension member.

The tip portions of the first shaft 103*a* and the second shaft 103*b* do not have an edge as shown in FIG. 10, but has a round shape like a spherical shape or a partially spherical shape. Thereby, when rotating the extension member 101, the frictional load applied to the tip portion of the shaft 103*a* and the shaft 103*b* and the walls 105*a* and 105*b* become small. Therefore, when rotating the extension member 101, just before reaching the critical region of rotating operation by hand, it will fit in the critical region of rotating operation by own weight. Here, the critical region of rotating operation means the extended position rotated toward the accommodated position or the sheet discharging direction stored in the depressed portion 72*b* on the main body 72*a*.

In the extension member of the sheet receiving tray according to the second embodiment, the extension member 101 is improved operability of the pivoting operation by that the walls 105*a* and 105*b* to which tip portions of the shafts 103*a* and 103*b* contact are provided to the sheet receiving tray, providing that the distance r between the walls 105*a* and 105*b* and the distance R from the tip portion of the shaft 103*a* to the tip portion of the shaft 103*b* having a relation of R>r in a state that the extension member 101 is not distorted.

In the above described embodiment, although the rear side shaft bearing hole 102*b* of the image forming apparatus is cut away the lower part of the shaft bearing hole 102*b* on the inclined side surface of the depressed portion 72*b* of the first receiving tray 72, the rear side shaft bearing hole 102*b* may also take a vertically long shape at in the inclined side surface of the depressed portion 102*b*.

What is claimed is:

1. A tray comprising:

a main body to support a sheet;

an extension member rotatably mounted to the main body and extending from the main body in a discharging direction of the sheet to support a part of the sheet discharged from the main body;

first and second shafts provided at an end of the extension member and inserted in first and second holes formed on the main body; and a projection being provided on the second shaft inserted in the second hole and no projections being provided on the first shaft inserted in the first hole.

2. The tray of claim 1, wherein the main body includes:

a depressed portion configured to accommodate the extension member of which both-sides are formed in oblique planes, wherein the first hole is formed on one oblique side-surface of the depressed portion so as that an axis of the first hole stays in parallel to an upper surface of the main body, to engage with the first shaft;

the second hole is formed on the other oblique side-surface of the depressed portion so as that an axis of the second hole stays in parallel to the upper surface of the tray, to engage with the second shaft; and the projection is provided on a tip of the second shaft at a sheet supporting side.

3. The tray of claim 1, further comprising:

a first wall provided on a back of a sheet supporting plane of the main body in contact with a tip portion of the first shaft; and a second wall provided on the back of the sheet supporting plane of the main body in contact with a tip portion of the second shaft, wherein a distance from the first wall to the second wall is shorter than a distance from the tip portion of the first shaft to the second shaft, at a state that the extension member is not distorted.

4. The tray of claim 3, wherein the tip portions of the first and second shafts are rounded.

5. An image forming apparatus including an image reading unit to read image from a document, an image forming unit to output the image, the document loading tray to load a document to be fed into the image reading unit, a sheet supply tray to supply a sheet into the image forming unit, a sheet receiving tray on which the sheet carrying the output image is discharged, wherein the sheet receiving tray comprises:

a main body to support the sheet or the document;

an extension member rotatably mounted to the main body and extending from the main body in a discharging direction of the sheet or document to support a part of the sheet or document discharged from the main body;

first and second shafts provided at an end of the extension member and inserted in first and second holes formed on the main body; and a projection being provided on the second shaft inserted in the second hole and no projections being provided on the first shaft inserted in the first hole.

6. The apparatus of claim 5, wherein the first shaft is engaged to a front side of the sheet receiving tray, and the second shaft is engaged to a rear side of the sheet receiving tray.

7. The apparatus of claim 5, wherein the main body includes:

a depressed portion of which both side surfaces to accommodate the extension member are inclined, wherein the first hole has an axis extending in parallel with an upper surface of the main body to engage the first shaft thereto, the second hole has an axis extending in parallel with a tray surface of the main body to engage the second shaft thereto, the second hole has a cut away section on an inclined plane of a lower side portion, and the projection is provided on a tip of the second shaft, on a side with a sheet supporter against the second shaft.

8. The apparatus of claim 5, further comprising:

a first wall provided in a back side of a sheet supporter of the main body in contacting with a tip of the first shaft, and a second wall provided in the back side of the sheet supporter of the main body in contacting with a tip of the second shaft, wherein a distance from the first wall to the second wall is shorter than a distance from the tip of the first shaft in the state where the extension member is not distorted to the tip of the second shaft.

9. The apparatus of claim 8, the tips of the first shaft and the second shaft have rounded shapes.

10. A sheet post-handling device provided with a sheet receiving tray to support a sheet to which the sheet is discharged after an image has been formed by an image forming apparatus, wherein the sheet receiving tray comprising:

a main body to support the discharged sheet;

an extension member rotatably mounted to the main body and extending from the main body in a discharging direction of the sheet to support a part of the sheet discharged from the main body;

first and second shafts provided at ends of the extension member and inserted in first and second holes formed on the main body; and a projection being provided on the second shaft inserted in the second hole and no projections being provided on the first shaft inserted in the first hole.

11. The device of claim 10, wherein the main body includes:

a depressed portion from which both side surfaces to accommodate the extension member are inclined, wherein the first hole has an axis extending in parallel with an upper surface of the main body to engage the first shaft thereto, the second hole has an axis extending in parallel with a tray surface of the main body to engage the second shaft thereto, the second hole has a cut away section on an inclined plane of a lower side portion, and the projection is provided on a tip of the second shaft, on a side with a sheet supporter against the second shaft.

12. The device of claim 11, further comprising:

a first wall provided on a back of a sheet supporting plane of the main body in contact with a tip portion of the first shaft; and a second wall provided on the back of the sheet supporting plane of the main body in contact with the tip portion of the second shaft, wherein a distance from the first wall to the second wall is shorter than a distance from the tip portion of the first shaft to the second shaft, at a state that the extension member is not distorted.

13. The device of claim 12, the tip portions of the first shaft and the second shaft have rounded shapes.

* * * * *